US008844460B2

(12) United States Patent
Cooney

(10) Patent No.: US 8,844,460 B2
(45) Date of Patent: Sep. 30, 2014

(54) PONTOON BOAT WALL AND METHOD OF MANUFACTURE

(75) Inventor: John R. Cooney, Midland, MI (US)

(73) Assignee: Avalon Pontoons, Alma, MI (US)

( * ) Notice: Subject to any disclaimer, the term of this patent is extended or adjusted under 35 U.S.C. 154(b) by 299 days.

(21) Appl. No.: 13/194,650

(22) Filed: Jul. 29, 2011

(65) Prior Publication Data

US 2013/0025519 A1 Jan. 31, 2013

(51) Int. Cl.
*B63B 1/12* (2006.01)

(52) U.S. Cl.
CPC .. *B63B 1/12* (2013.01); *B63B 1/125* (2013.01)
USPC ..... 114/364; 114/343; 114/61.1

(58) Field of Classification Search
USPC ..... 114/343, 364, 61.1; 29/428, 469.5; 256/21, 24, 73; 156/196, 201
See application file for complete search history.

(56) References Cited

U.S. PATENT DOCUMENTS 5,485,801 A * 1/1996 Gibbs ..... 114/219
7,913,637 B2 * 3/2011 Roehm et al. ..... 114/363

OTHER PUBLICATIONS

Restorepontoon.com http://www.restorepontoon.com/pontoon/pc/Vinyl-Fence-Paneling-65p79.htm#details Jul. 18, 2009.*

* cited by examiner

*Primary Examiner* — Edwin Swinehart
(74) *Attorney, Agent, or Firm* — Robert L. Stearns; Dickinson Wright, PLLC

(57) ABSTRACT

A pontoon boat including at least two pontoons and a deck supported on the pontoons. A wall assembly is anchored to the deck and extends generally upwardly therefrom to present an interior space for accommodating passengers. The wall assembly is composed of a plurality of wall segments, each including an open framework of extruded hollow beam members with an open area between the beam members. Each wall segment also includes at least one panel covering at least a portion of the open area, and the panel is secured by an adhesive along at least three of its edge regions to the beam members.

6 Claims, 6 Drawing Sheets

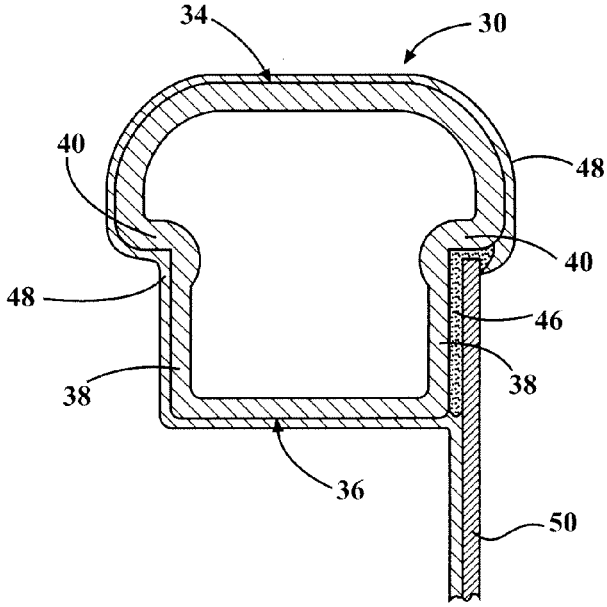
FIG. 5
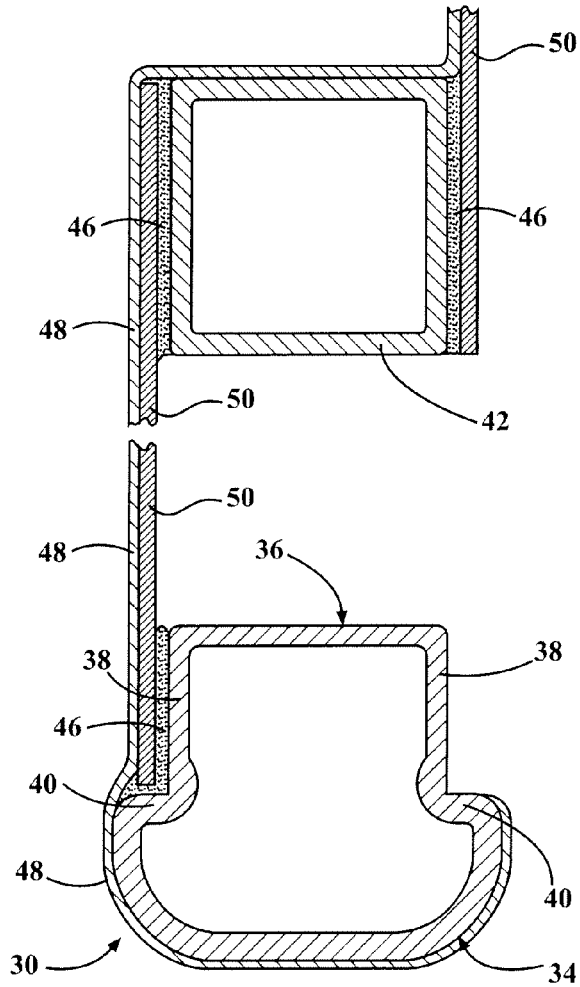

PONTOON BOAT WALL AND METHOD OF MANUFACTURE

BACKGROUND OF THE INVENTION

1. Field of the Invention

The invention is directed to pontoon boats, and more particularly to the wall assembly of a pontoon boat.

2. Description of the Related Art

Pontoon boats are becoming an increasingly popular choice among boat owners who are looking for a vessel that can accommodate a large family or group of people in a comfortable environment for leisure and/or entertainment purposes. Additional advantages of pontoon boats over other options include their ability to navigate shallow water with ease, their relatively low cost compared to other boat options of comparable size, the ability to configure the deck area with a variety of seating configurations and other options, and their ease of handling to name just a few.

Pontoon boats are typically constructed to include a generally flat platform or deck which is mounted to two or more hollow, tubular floatable pontoons to support the deck off the water. The typical construction further includes some type of barrier or wall system that extends about the perimeter of the deck to define a passenger space and some type of seating arrangement within the passenger space.

The wall system itself includes multiple sections of tubular structural framing that is anchored to the decking. Often, the open areas of the framing are fitted with decorative panels, or skins, of sheet metal to provide a solid wall appearance as well as a containment barrier for the passengers on board.

One type of wall system in many modern pontoon boats is curved to provide the pontoon boat with a clean and luxurious external appearance. Known curved pontoon walls of the prior art are made by first forming the tubular framework in planar sections and securing panels to the framework with fasteners, e.g. rivets. Once the planar wall sections are formed, they are roll formed as needed to bend all or part of the wall section to the desired curvature. A problem inherent with this approach is that it places great stress on the wall segments, and particularly the panels which are generally no greater than three hundredths of an inch (0.03 in) thick. The stress of the bending operation is born in part by the panels and they tend to stretch and distort under the stress giving the panels a non-uniform appearance (e.g., buckling, dents, kinks, etc). Some manufactures have tried to minimize the appearance of these stress-induced imperfections by employing a corrugated or ribbed panel material which helps with the defects, but which also detracts from a smooth appearance of the panels that may be more appealing to some boat owners.

SUMMARY OF THE INVENTION

An aspect to the invention is to provide a curved wall segment for a wall system of a pontoon boat with an improved structural integrity, cost and appearance. According to a particular feature of this improved wall segment, a frame of a plurality of hollow beam members is formed and bent through at least one curve. During or after the bending of the frame, a panel is bonded to the frame. Because the panel is bonded to the frame during or after rather than before the bending process, the it is substantially free of internal stresses, even through the curve in the wall segment. Such a stress-free panel can be made thick enough to resist dents from the forces a pontoon boat will encounter during everyday use. Therefore, the panel can be made with a generally smooth external surface, which many customers may find to be appealing.

Another advantage of the panel being substantially free of internal stresses is that the wall segment has a reduced risk of ripping and/or breaking, especially in the area of the curve.

According to another aspect of the invention, at least one of the beams has a generally mushroom-shaped cross-section with an enlarged head portion and a relatively narrow body portion. The narrow body portion has two outer side surfaces that are laterally inset from the head portion. L-shaped steps extend between and interconnect the head and body portions. The panel overlies at least one of the outer side surfaces, and the panel has a thickness which is less than the length of the associated L-shaped step. This is advantageous for a number of reasons, including protecting the edges of the panels from direct contact by external forces to preclude bending, chipping, delamination and the like, and also because it provides a very clean, aesthetically pleasing, robust appearance to the wall segments.

According to yet a further aspect of the invention, at least some adhesive interconnecting the frame and panel extends to a front portion of the panel. This adhesive creates a zone of protection for the edge of the panel and further secures the panel to the frame. Optionally, the panel and frame can be painted together to create a layer of paint which further reinforces the connection between the panel and the frame.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a cross-sectional view taken along line 5-5 of FIG. 1;

DETAILED DESCRIPTION OF THE ENABLING EMBODIMENTS

Figure 1:
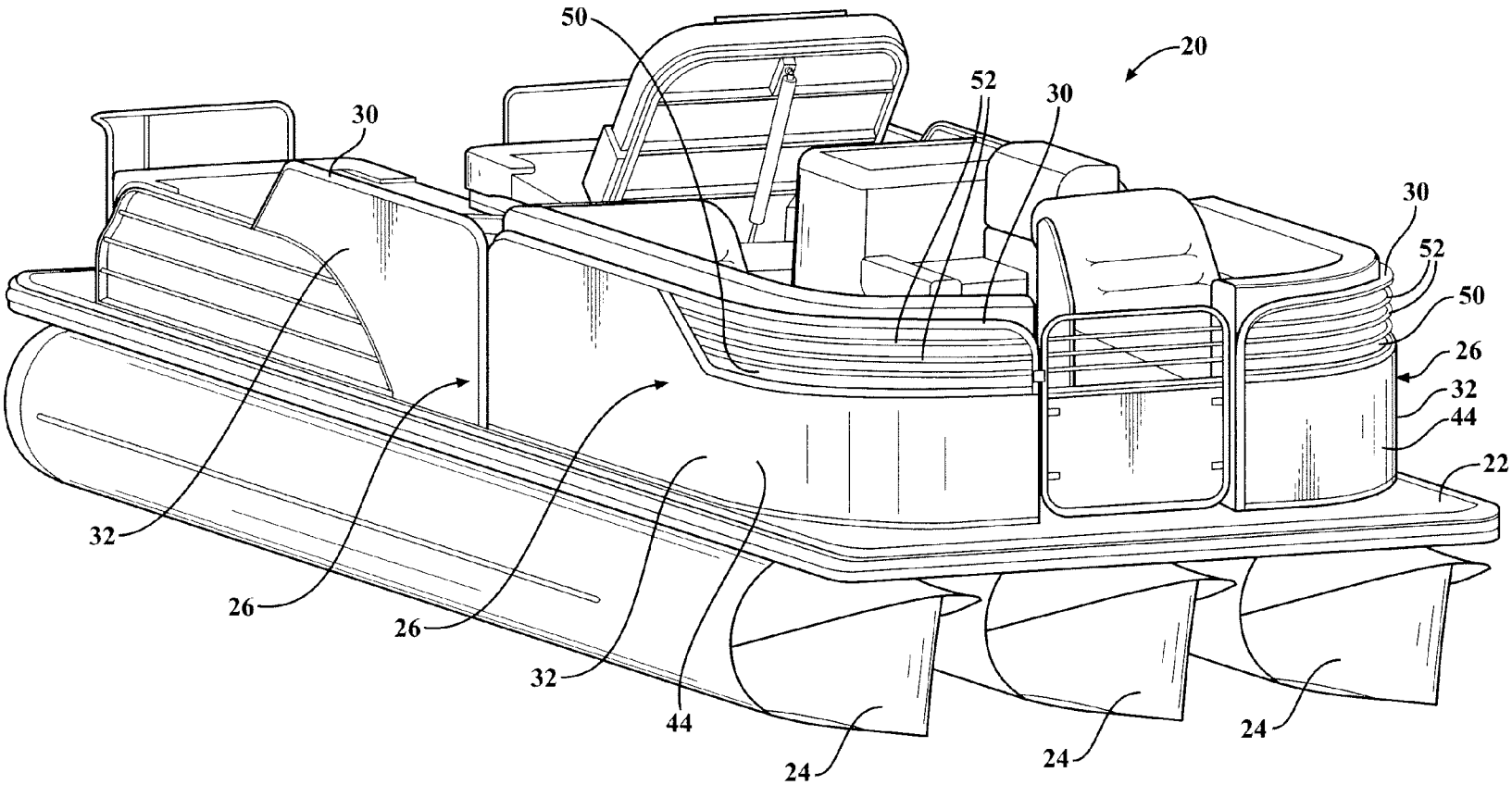
FIG. 1 is a perspective and elevation view of an exemplary pontoon boat.

Referring to the Figures, wherein like numerals indicate corresponding parts throughout the several views, an exemplary pontoon boat 20 is generally shown in FIG. 1. The pontoon boat 20 includes a flat platform, or a deck 22, secured to a plurality of hollow, tubular floatable pontoons 24 extending in spaced and parallel relationship with one another to support the deck 22 off the water. The exemplary pontoon boat 20 has three pontoons 24; however, it should be appreciated that the pontoon boat 20 could have any desirable number of pontoons 24 (e.g., only two or more than three).

Figure 2:
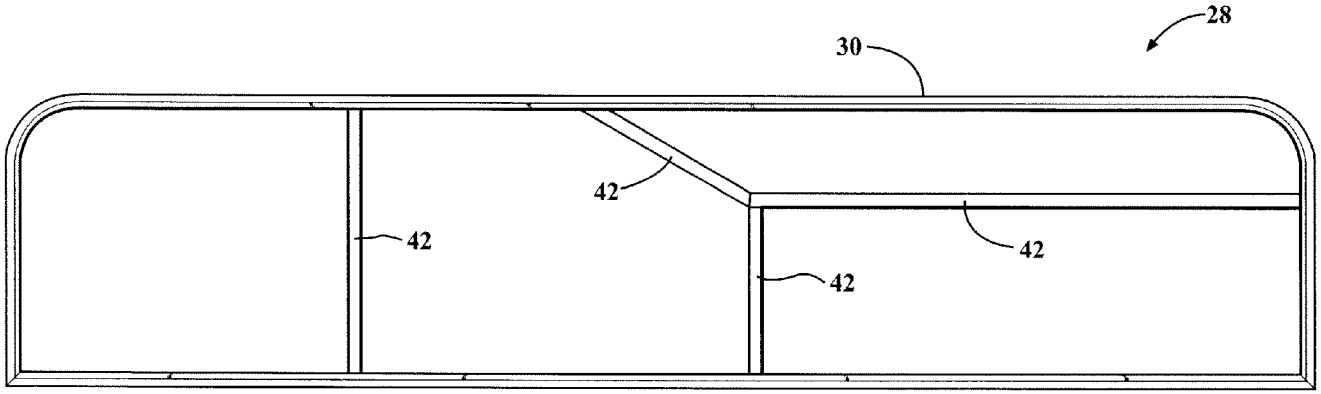
FIG. 2 is a front view of a frame of the frame of one of the wall segments of the exemplary embodiment before the bending process.
Figure 3:
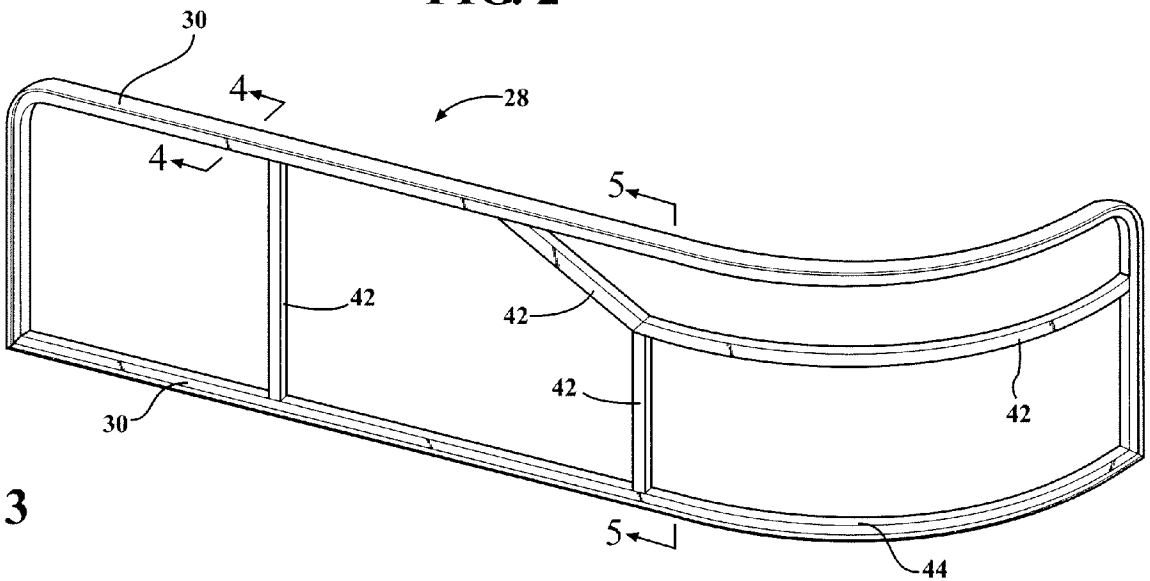
FIG. 3 is a perspective and elevation view of the frame after being bent through a curve.

The pontoon boat 20 includes a wall assembly comprising a plurality of wall segments 26 which extend about the perimeter of the deck 22 to define an interior space for accommodating passengers. Each of the wall segments 26 is anchored on the deck 22 and extends generally upwardly therefrom. As shown in FIGS. 2 and 3, each wall segment 26 includes a frame 28 of tubular beam members 30 secured to one another. Referring back to FIG. 1, at least one panel 32 of sheet metal is attached to the frame 28 over the open areas to provide the wall segment 26 with a solid appearance as well as a containment barrier for the passengers on board.

Figure 4A:
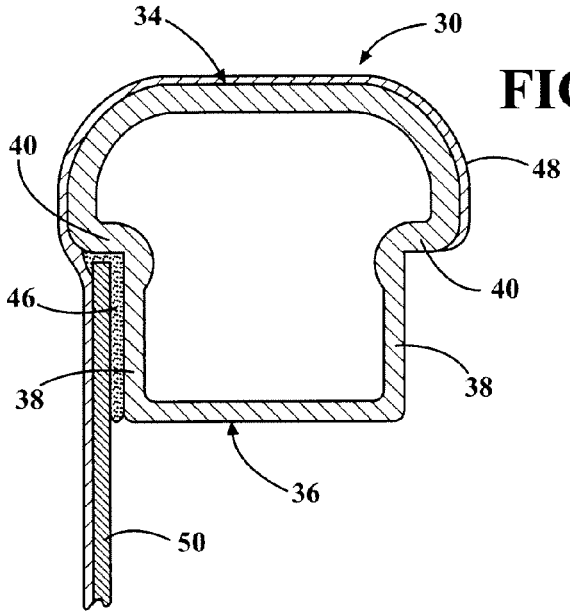
FIG. 4*a* is a cross-sectional view taken along line 4-4 of FIG. 3 of one of the beams of the frame with a panel bonded to one side of the body portion.
Figure 4B:
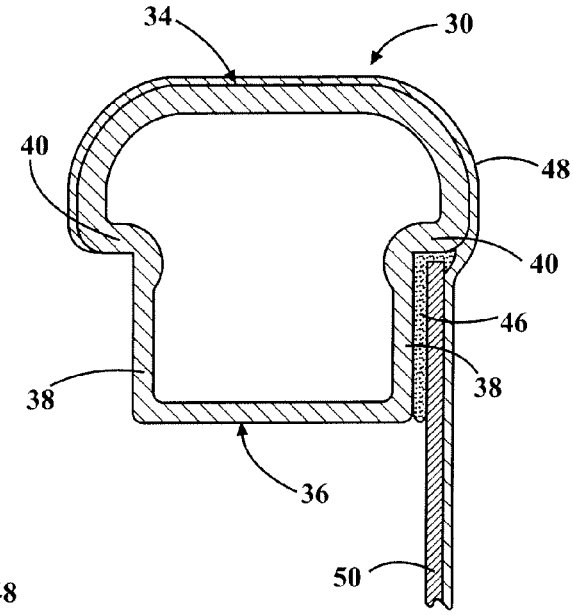
FIG. 4*b* is a cross-sectional view taken along line 4-4 of FIG. 3 of one of the beams of the frame with a panel bonded to another side of the body portion.
Figure 4C:
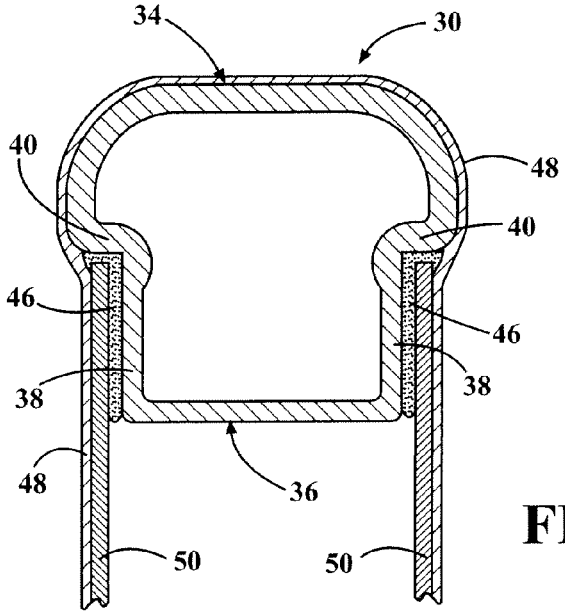
FIG. 4*c* is a cross-sectional view taken along line 4-4 of FIG. 3 of one of the beams of the frame with panels bonded to both sides of the body portion.

As shown in FIGS. 4*a-c*, the beam members 30 disposed along the perimeter of the frame 28 have a generally mushroom-shaped (or slice-of-bread-shaped) cross-section with an enlarged head portion 34 and a relatively narrow waist or body portion 36. The body portion 36 presents two generally flat outer side surfaces 38 that are laterally inset from the head portion 34, and each beam member 30 also includes an L-shaped step 40 in a transition area between the head portion 34 and each of the outer side surfaces 38 of the body portion 36. In the exemplary embodiment, the head portion 34 of the perimeter beam members 30 is approximately two inches wide. However, it should be appreciated that the beam members 30 could have any desirable width. The exemplary frame 28 additionally includes a plurality of interior beam members 42, which have a generally rectangular cross-section rather than the mushroom-shaped cross-section of the perimeter beam members 30.

The beam members 30 are preferably formed as aluminum extrusions having the desired cross-section, and the beam members 30 are preferably secured to one another through welding. However, it should be appreciated that the beam members 30 could be of any desirable material, formed through any desirable forming process, and secured to one another through any desirable process.

As shown in FIG. 1, the two front wall segments 26 of the exemplary pontoon boat 20 each extend through ninety degree (90°) curves. This curvature 44 is produced in each of the wall segments 26 by bending the completed frame 28, and the curve 44 could have any desirable radius within the structural limits of the frame 28. In other words, a curve radius should be selected that is large enough to avoid crimping or deforming the beam members 30 during the bending process.

As described above, at least one panel 32 is applied to the frame 28 to give the wall segment 26 a solid appearance. After the frame 28 is bent to a predetermined curve 44, an adhesive 46 is applied to the perimeter beam members 30 and/or to the edges of the panel 32. The adhesive 46 is preferably applied to both the outer side surface 38 of the body portion 36 and to the L-shaped step 40 between the head and body portions 34, 36. To bond the panel 32 to the frame 28, one end of the panel 32 is first clamed to the frame 28 such that the panel 32 overlies one of the outer side surfaces 38 of the perimeter beam members 30 and the edge of the panel 32 abuts the L-shaped step 40. When the panel 32 is pressed against the frame 28, at least some of the adhesive 46 should disposed on the front surface of the panel 32 to provide additional protection to the edges of the panel 32. In the exemplary embodiment, the adhesive 46 is Maxlok™ MX/T18, which is a product of the Lord Corporation. However, it should be appreciated that any desirable adhesive may be used.

Next, the length of the panel 32 is progressively pressed to the frame 28 such that the edge of the panel 32 overlies one of the side surfaces 38 of the beam members 30. This process is continued through the curve 44 to bond the panel 32 to the frame 28. It may be necessary to use one or more clamps to hold the panel 32 against the frame 28 through the curve 44 until the adhesive 46 is finished curing. In the exemplary embodiment, the adhesive 46 is sufficient to interconnect the panel 32 and the frame 28; however, additional connectors could be added for additional reinforcement if desired.

In the exemplary embodiment, each of the panels 32 has a generally smooth exterior surface, which gives the pontoon boat 20 a smooth, high-quality external appearance. The panel 32 of the exemplary embodiment is approximately six one-hundredths of an inch (0.06 in) thick. However, it should be appreciated that the panel 32 could have any desirable thickness. Because the panel 32 is applied during or after the bending process is complete, it is substantially free of internal stresses, which improves its ability to absorb forces without deforming or tearing.

It should be appreciated that the same type of beam member 30 could be used to for both the port (left) and starboard (right) wall segments 26 of the pontoon boat 20. For example, in FIG. 4*a*, the panel 32 is applied to one side surface 38 of the body portion 36 of the frame 28 for use in a wall segment 26 on the port side of the pontoon boat 20. In FIG. 4*b*, the panel 32 is bonded to the opposite side of the body portion 36 of the frame 28 for a wall segment 26 on the starboard side of the pontoon boat 20. Alternately, as shown in FIG. 4*c*, it might be desirable to bond panels 32 to both side surfaces 38 so that the wall segment 26 can be used for either side of the pontoon boat 20.

Also shown in FIGS. 4*a-c*, the L-shaped step 40 is wider than the panels 32. Thus, because a portion of the frame 28 extends outwardly from the panels 32 to protect the panels 32 from certain forces which could occur during the life of the pontoon boat 20. For example, if the pontoon boat 20 contacts a dock, the hollow beam members 30 may absorb the force from the contact rather than the panels 32.

Once the panels 32 are finished bonding to the frame 28, then the wall segment 26 is primed and painted. In the exemplary embodiment, both the frame 28 and the panels 32 are painted, however it might be desirable to only paint the panels 32 and not the frame 28. The resulting layer 48 of primer and paint, which is best shown in FIGS. 4*a-c*, further strengthens the connection between the frame 28 and the panels 32.

As shown in FIG. 1, the front port and starboard wall segments 26 include a second panel 50, which is recessed relative to a first panel 32. As shown in FIG. 5, a portion of the first panel 32 is bonded to a flat surface on one of the internal beam members 30 described above. Then, after the paint and primer have been applied to the frame 28 and the first panel 32, the second panel 50 is bonded to the back of the body portion 36 the unconnected perimeter beam member 30 and to the internal beam member 30 opposite of the first panel 32. The second panel 50 can be of a different color than the first panel 32, which provides the wall segment 26 with a unique exterior appearance. Moreover, additional features, such as a decorative rail 52 could be mounted to the wall segment 26 in this area to further improve the appearance of the pontoon boat 20.

Figure 6:
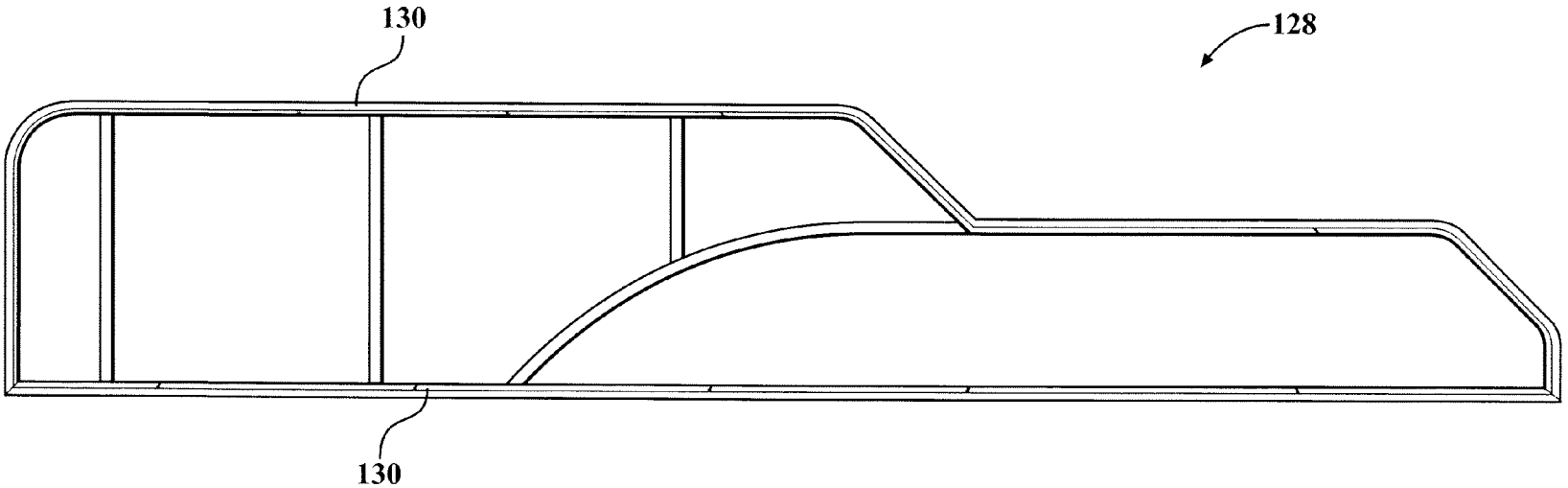
FIG. 6 is a front view of an alternate embodiment of a frame before the bending process.

FIG. 6 shows an alternate frame 128 composed of a plurality of beam members 130 before being bent into a curve. This is but one example of an alternate frame 128, and it should be appreciated that the frame could take alternate shapes other than those shown in the exemplary embodiments.

Figure 7:
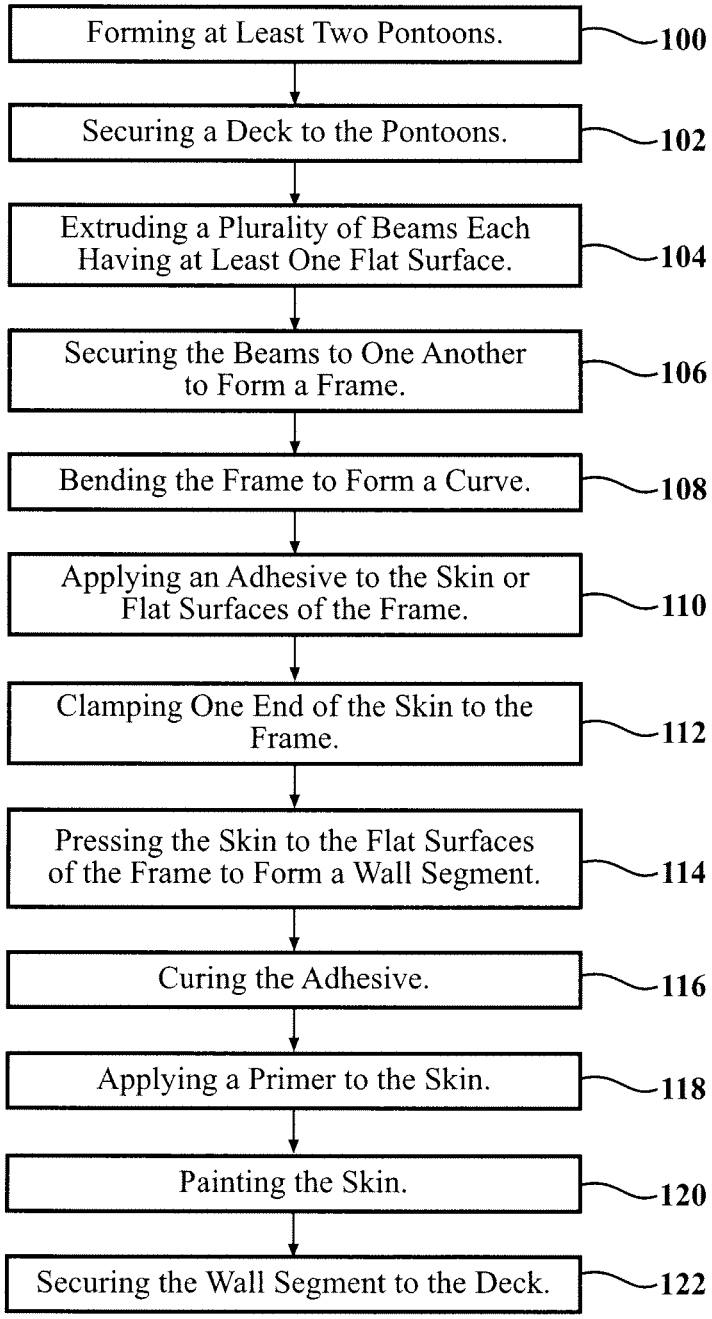
FIG. 7 is a flowchart of an exemplary method.

A flow chart for an exemplary method of manufacturing a pontoon boat 20 is shown in FIG. 7. The exemplary method starts with the step 100 of forming at least two pontoons 24. The pontoons 24 are preferably of a metal, such as aluminum, though it should be appreciated that any other type of material could be used. The method then continues with the step 102 of positioning the pontoons 24 in spaced and parallel relationship with one another. Once the pontoons 24 are properly positioned, the method continues with the step 40 of securing a lower surface of a deck 22 to the pontoons 24.

The exemplary method then continues with the step 104 of extruding a plurality of beam members 30, with each beam having at least one flat surface. As discussed above, each beam preferably has a cross-section defining a first portion and a wider second portion. The method then continues with the step 106 of securing the beams to one another in a predetermined configuration to form a frame 28 for a wall segment 26. In the exemplary method, the beams are welded to one another to form the frame 28. However, it should be appreciated that any means of securing the beams together could alternatively be used including, for example, fasteners or adhesives 46.

The method then continues with the step 108 of bending the frame 28 to form at least one curve 44. The curve 44 could have any desirable sharpness and angle. Once the panel 32 is formed and shaped, the method continues with the step 110 of applying an adhesive 46 to a generally smooth panel 32 and/or one of the flat surfaces of the beams of the frame 28. In the exemplary method, the panel 32 is of 0.06 inch thick aluminum. However, as discussed above, the panel 32 could have any desirable thickness and could be of any desirable material. The panel 32 is preferably cut to shape using a water-cutting process. However, any desirable process could be used to shape the panel 32.

Next, the method continues with the step 112 of clamping one end of the panel 32 to one end of the frame 28. The method then continues with the step 114 of progressively pressing the panel 32 to the flat surfaces of the frame 28 from the clamped end to the opposite end. Through the curve 44, additional clamps might be applied to hold the panel 32 against the flat surfaces of the frame 28 while the adhesive 46 cures. The method then continues with the step 116 of curing the adhesive 46. It should be appreciated that the time required to cure the adhesive 46 will vary according to the adhesive 46 used.

Next, the exemplary method continues with the steps 118, 120 of applying a primer to the panel 32 and painting the panel 32. It should be appreciated an exterior coating, such as a clear coating, could optionally be applied on top of the paint to enhance the appearance of the panel 32 and/or to protect the paint. Once the wall segment 26 is complete, the method continues with the step 122 of securing the wall segment 26 to the deck 22 of the pontoon boat 20.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A pontoon boat comprising:

at least two pontoons;

a deck supported on said pontoons;

a wall assembly mounted on said deck and extending generally upwardly therefrom, said wall assembly including at least one wall section formed of an open framework of extruded hollow beam members with at least one open area between said beam members;

at least one panel covering at least a portion of said at least one open area, said panel being secured by an adhesive along at least three edge regions to associated ones of said beam members; and wherein each of said beams has a generally mushroom-shaped cross section with an enlarged head portion and a relatively narrower body portion with two outer side surfaces that are laterally inset from said head portion and including an L-shaped step in transition between said head portion and each of said outer side surfaces of said body portion.

2. The pontoon boat as set forth in claim 1 wherein said adhesive is applied to at least one of said two outer side surfaces and an associated one of said edges of said panel overlies said at least one side surface.

3. The pontoon boat as set forth in claim 2 wherein said adhesive is further applied to said step and is adhered to an associated end face of said associated panel.

4. The pontoon boat as set forth in claim 3 wherein said adhesive further extends to a front portion of said panel.

5. The pontoon boat of as set forth in claim 4 including a finish coating of paint applied to said beam member and said panel.

6. The pontoon boat as set forth in claim 5 wherein said panel has a periphery being shaped to abut the steps of the beam members of the frame.

* * * * *